US011289247B2

(12) United States Patent
Hoshino

(10) Patent No.: US 11,289,247 B2
(45) Date of Patent: Mar. 29, 2022

(54) ELECTRONIC COMPONENT AND METHOD OF MANUFACTURING ELECTRONIC COMPONENT

(71) Applicant: Murata Manufacturing Co., Ltd., Kyoto-fu (JP)

(72) Inventor: Yuuta Hoshino, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 16/930,118

(22) Filed: Jul. 15, 2020

(65) Prior Publication Data

US 2021/0043340 A1 Feb. 11, 2021

(30) Foreign Application Priority Data

Aug. 9, 2019 (JP) ..... JP2019-147658

(51) Int. Cl.

| | |
|---|---|
| ***H01C 7/04*** | (2006.01) |
| ***H01C 17/28*** | (2006.01) |
| ***H01C 17/065*** | (2006.01) |
| ***H01C 1/14*** | (2006.01) |

(52) U.S. Cl.

CPC ..... *H01C 7/041* (2013.01); *H01C 1/1413* (2013.01); *H01C 17/065* (2013.01); *H01C 17/28* (2013.01)

(58) Field of Classification Search

CPC .... H01C 7/041; H01C 1/1413; H01C 17/065; H01C 17/28

See application file for complete search history.

(56) References Cited

U.S. PATENT DOCUMENTS

| | | | | |
|---|---|---|---|---|
| 5,750,264 | A * | 5/1998 | Ueno | C04B 35/47 428/426 |
| 6,177,857 | B1 * | 1/2001 | Inoue | H01C 1/14 338/22 R |
| 8,081,059 | B2 * | 12/2011 | Tanimura | H01C 1/148 338/309 |
| 2009/0108984 | A1 * | 4/2009 | Choi | H01C 17/06533 338/22 R |
| 2009/0191418 | A1 * | 7/2009 | Nakano | H01C 7/18 428/469 |
| 2012/0056709 | A1 * | 3/2012 | Kajino | C04B 38/0615 338/22 R |
| 2012/0188051 | A1 * | 7/2012 | Miura | H01C 1/1413 338/22 R |
| 2014/0210628 | A1 * | 7/2014 | Kim | G08B 17/06 340/590 |
| 2014/0266567 | A1 * | 9/2014 | Watanabe | G01K 7/22 338/22 R |
| 2016/0024346 | A1 * | 1/2016 | Inoue | H01G 4/224 361/301.4 |
| 2017/0202089 | A1 * | 7/2017 | Yun | H01C 7/18 |

FOREIGN PATENT DOCUMENTS

JP 2009-285631 A 12/2009

* cited by examiner

*Primary Examiner* — Kyung S Lee

(74) *Attorney, Agent, or Firm* — Studebaker & Brackett PC

(57) ABSTRACT

A negative-temperature-coefficient thermistor component includes a core. Surfaces of the core are partially covered with a first insulating layer. Surfaces of the core are partially covered with a second insulating layer. The first insulating layer and the second insulating layer overlap each other on a first side surface and a second side surface, each of which is one of the surfaces of the core.

21 Claims, 4 Drawing Sheets

ELECTRONIC COMPONENT AND METHOD OF MANUFACTURING ELECTRONIC COMPONENT

CROSS-REFERENCE TO RELATED APPLICATION

This application claims benefit of priority to Japanese Patent Application No. 2019-147658, filed Aug. 9, 2019, the entire content of which is incorporated herein by reference.

BACKGROUND

Technical Field

The present disclosure relates to an electronic component and a method of manufacturing an electronic component.

Background Art

In an electronic component described in Japanese Unexamined Patent Application Publication No. 2009-285631, a glass film covers the entire surface of a component body. The glass film is formed by spraying a glass slurry from a nozzle such that the glass slurry is deposited onto the component body of the electronic component in a state where the component body is sealed in a barrel, which is a container. In this case, the glass slurry is deposited onto the entire surface of the component body as a result of rotation of the barrel. After the glass slurry has been deposited on the component body, the component body is dried by warm air, so that the glass film is deposited onto the entire surface of the component body.

SUMMARY

In the method of manufacturing an electronic component described in Japanese Unexamined Patent Application Publication No. 2009-285631, while the glass slurry can be deposited onto the entire surface of the component body, a large amount of the glass slurry is also deposited onto the inner surface of the barrel. Consequently, the barrel needs to be regularly cleaned, and this hinders simplification of the manufacturing method and an improvement in the manufacturing efficiency.

Accordingly, an electronic component according to a preferred embodiment of the present disclosure includes a component body, a first coating layer that partially covers a surface of the component body, and a second coating layer that partially covers the surface of the component body. The electronic component has an overlapping region in which the first coating layer and the second coating layer overlap each other.

Also, a method of manufacturing an electronic component including a component body, a first coating layer that partially covers a surface of the component body, and a second coating layer that partially covers the surface of the component body, according to another preferred embodiment of the present disclosure, includes a first coating application step of applying a first coating to a portion of the surface of the component body and drying the first coating, a second coating application step of applying a second coating to a portion of the surface of the component body and drying the second coating, and a curing step of curing the first coating so as to form the first coating layer and curing the second coating so as to form the second coating layer. In the second coating application step, the second coating is applied so as to overlap a portion of the first coating.

According to each of the above configurations, when the first coating layer is formed, a portion of the surface of the component body that is not to be covered with the first coating layer can be held. In addition, when the second coating layer is formed, the portion of the surface of the component body that is not covered with the first coating layer or a portion of the surface of the component body, the portion being covered with the first coating layer that has already been dried, can be held. Consequently, when the electronic component is manufactured, the electronic component is held at portions thereof that do not have the undried coating layer deposited thereon, and the material of each of the coating layers does not adhere to a holder for holding the electronic component, or only a small amount of the material of each of the coating layer may adhere to the holder. Therefore, the time and effort needed for cleaning or replacing the holder for holding the electronic component can be saved, and this can contribute to simplification of the manufacturing method and an improvement in the manufacturing efficiency. In addition, according to each of the above configurations, in the portion in which the first coating layer and the second coating layer overlap each other, an improvement in the strength of the entire electronic component can be expected.

According to an electronic component and a method of an electronic component, each of which is an aspect of the present disclosure, a decrease in manufacturing efficiency can be suppressed.

Other features, elements, characteristics and advantages of the present disclosure will become more apparent from the following detailed description of preferred embodiments of the present disclosure with reference to the attached drawings.

DETAILED DESCRIPTION

Figure 1:
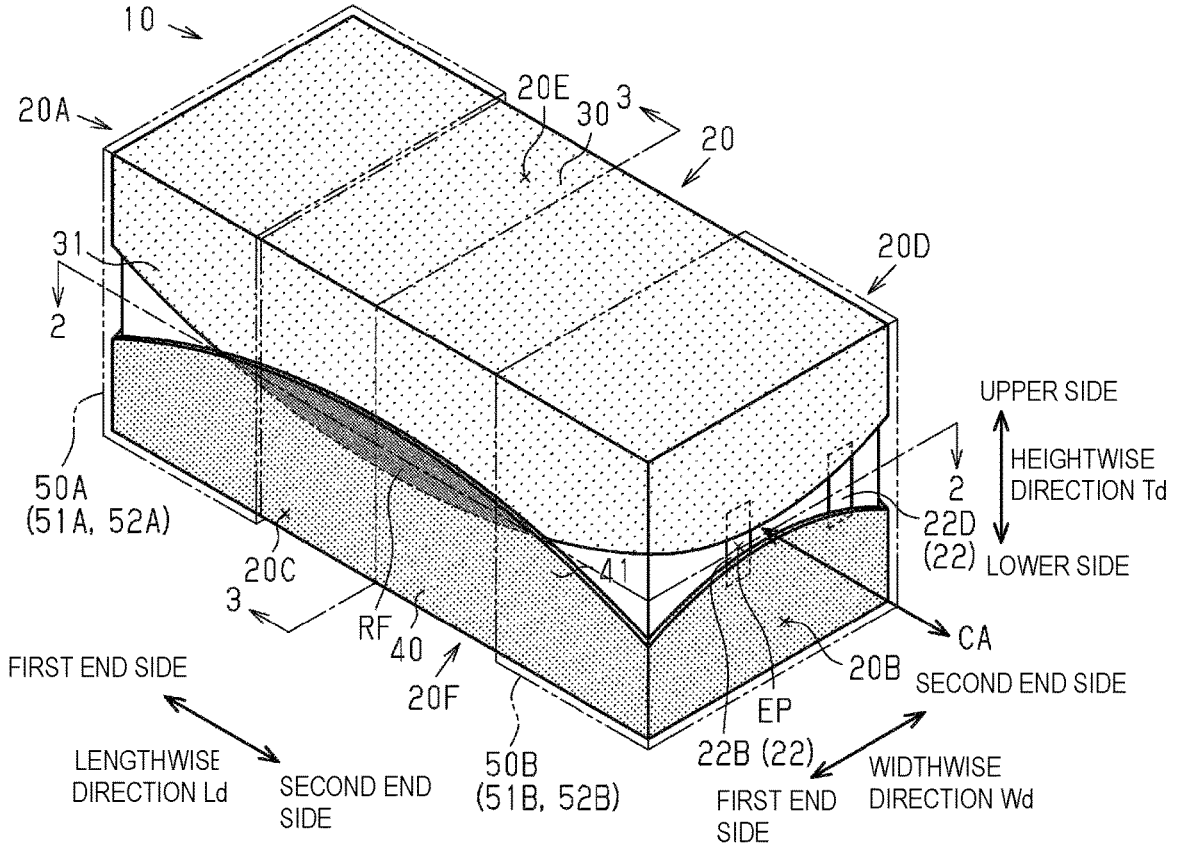
FIG. 1 is a perspective view of an electronic component of a first embodiment.

An electronic component and a method of manufacturing an electronic component according to each embodiment will be described below with reference to the drawings. Note that some components may be illustrated in an enlarged manner in the drawings for ease of understanding. The dimensional ratios of the components may sometimes be different from the dimensional ratios of actual components or may sometimes differ between the drawings.

First Embodiment

First, an electronic component and a method of manufacturing an electronic component according to the first embodiment will be described.

As illustrated in FIG. 1, the electronic component is, for example, a surface-mount negative-temperature-coefficient (NTC) thermistor component 10 that is mounted onto a circuit board or the like. The NTC thermistor component 10 functions as an electronic component whose resistance decreases as its temperature increases. The NTC thermistor component 10 includes a core 20 that serves as a component body.

The core 20 is in the shape of a substantially square prism, and for example, the length of the core 20 in a direction in which a central axis CA extends is longer than the length of one side of the substantial square shape. The core 20 is made of a ceramic obtained by firing an oxide containing manganese, nickel, cobalt, or the like. Note that, in the following description, the direction in which the central axis CA of the core 20 extends will be referred to as a lengthwise direction Ld. In addition, a heightwise direction Td and a widthwise direction Wd each of which is perpendicular to the lengthwise direction Ld will be defined as follows. The heightwise direction Td is one of the directions that are perpendicular to the lengthwise direction Ld, the one direction being perpendicular to a main surface of a circuit board in a state where the NTC thermistor component 10 is mounted on the circuit board. The widthwise direction Wd is one of the directions that are perpendicular to the lengthwise direction Ld, the one direction being parallel to the main surface of the circuit board in a state where the NTC thermistor component 10 is mounted on the circuit board.

The surfaces of the core 20 may be broadly divided into a first end surface 20A, which is an end surface located on a first end side in the lengthwise direction Ld, a second end surface 20B, which is an end surface located on a second end side in the lengthwise direction Ld, and four outer peripheral surfaces. The four outer peripheral surfaces include a first side surface 20C located on a first end side in the widthwise direction Wd, a second side surface 20D located on a second end side in the widthwise direction Wd, an upper side surface 20E located on an upper side in the heightwise direction Td, and a lower side surface 20F located on a lower side in the heightwise direction Td.

Figure 2:
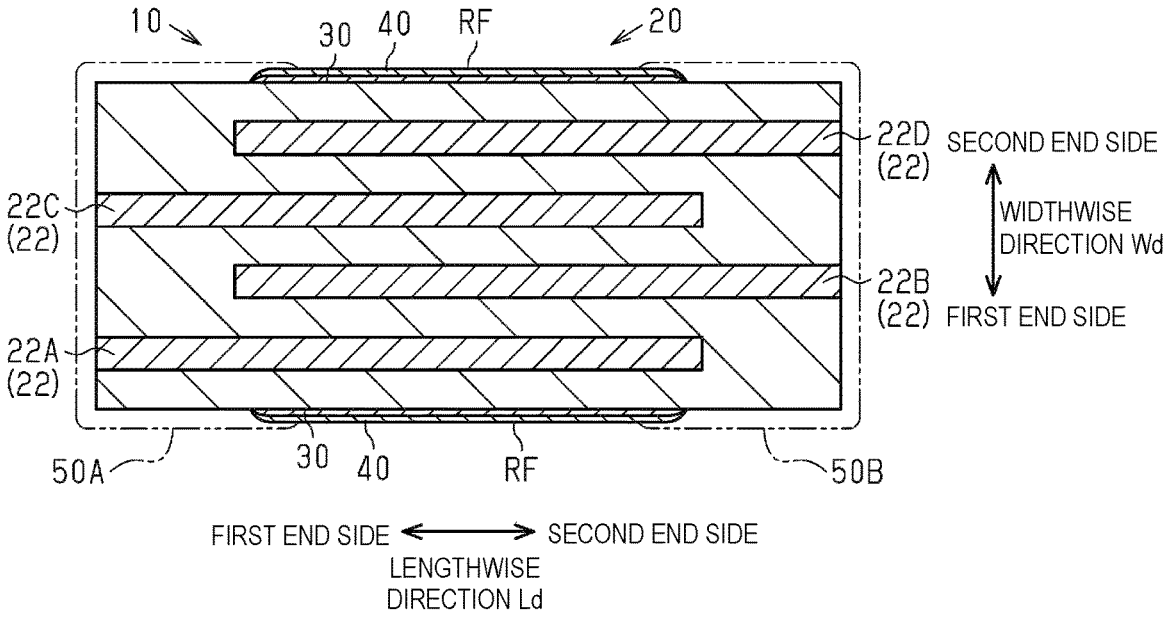
FIG. 2 is a sectional view of the electronic component illustrated in FIG. 1 taken along a one-dot chain line 2.

FIG. 2 illustrates a cross section taken along the lengthwise direction Ld and the widthwise direction Wd at the center of the NTC thermistor component 10 in the heightwise direction Td. As illustrated in FIG. 2, for example, four inner electrodes 22 each of which has the shape of a substantially rectangular plate are embedded in the core 20. The longitudinal direction of each of the inner electrodes 22 matches the lengthwise direction Ld. As illustrated in FIG. 1, the inner electrodes 22 are arranged such that the transverse direction and the thickness direction of the inner electrodes 22 respectively matches the heightwise direction Td and the widthwise direction Wd.

As illustrated in FIG. 2, the dimension of a first inner electrode 22A in the lengthwise direction Ld is slightly smaller than the dimension of the core 20 in the lengthwise direction Ld. As illustrated in FIG. 1, the dimension of the first inner electrode 22A in the heightwise direction Td is approximately one-third of the dimension of the core 20 in the heightwise direction Td. In addition, the first inner electrode 22A is positioned at the center of the core 20 in the heightwise direction Td. A second inner electrode 22B, a third inner electrode 22C, and a fourth inner electrode 22D each have the same shape as the first inner electrode 22A.

As illustrated in FIG. 2, the first inner electrode 22A, the second inner electrode 22B, the third inner electrode 22C, and the fourth inner electrode 22D are arranged in the widthwise direction Wd in this order from the first end side in the widthwise direction Wd. In the first embodiment, the inner electrodes 22 are equally spaced.

As illustrated in FIG. 2, one end of the second inner electrode 22B and one end of the fourth inner electrode 22D that are located on the second end side in the lengthwise direction Ld are exposed at the second end surface 20B of the core 20 in the lengthwise direction Ld. In contrast, the other end of the second inner electrode 22B and the other end of the fourth inner electrode 22D that are located on the first end side in the lengthwise direction Ld are positioned inside the core 20.

One end of the first inner electrode 22A and one end of the third inner electrode 22C that are located on the first end side in the lengthwise direction Ld are exposed at the first end surface 20A of the core 20 in the lengthwise direction Ld. In contrast, the other end of the first inner electrode 22A and the other end of the third inner electrode 22C that are located on the second end side in the lengthwise direction Ld are positioned inside the core 20.

As illustrated in FIG. 1, a first insulating layer 30 partially covers the surfaces of the core 20. The first insulating layer 30 is made of a material having an insulating property higher than that of the core 20. More specifically, the first insulating layer 30 is made of glass. In the first embodiment, the first insulating layer 30 functions as a first coating layer.

The first insulating layer 30 covers the entire upper side surface 20E, which is one of the four outer peripheral surfaces of the core 20 that are parallel to the central axis CA. In addition, the first insulating layer 30 partially covers the first side surface 20C and the second side surface 20D that are respectively located on the first end side and the second end side in the widthwise direction Wd, the first side surface 20C and the second side surface 20D each being one of the four outer peripheral surfaces of the core 20 and each being adjacent to the upper side surface 20E. Furthermore, the first insulating layer 30 partially covers the first end surface 20A of the core 20, which is located on the first end side in the lengthwise direction Ld, and the second end surface 20B of the core 20, which is located on the second end side in the lengthwise direction Ld.

More specifically, when viewed in the widthwise direction Wd, the first insulating layer 30 covers approximately the upper half of the first side surface 20C in the heightwise direction Td. In the heightwise direction Td, an area of the first side surface 20C that is covered with the first insulating layer 30 is widest at the center of the first side surface 20C in the lengthwise direction Ld and becomes narrower in the heightwise direction Td with increasing distance from the center of the first side surface 20C in the lengthwise direction Ld. A lower end of the first insulating layer 30 in the heightwise direction Td is positioned below the center of the core 20 in the heightwise direction Td at the center of the first side surface 20C in the lengthwise direction Ld. In other words, an edge of the area of the first side surface 20C, the area being covered with the first insulating layer 30, is curved so as to protrude toward the lower side in the heightwise direction Td at the center of the first side surface 20C in the lengthwise direction Ld. In the first embodiment, a lower portion of the first insulating layer 30 in the heightwise direction Td on the first side surface 20C is a first protruding portion 31.

The first insulating layer 30 covers an upper portion of the second side surface 20D in the heightwise direction Td. An area of the second side surface 20D that is covered with the first insulating layer 30 is the same as the area of the first side surface 20C that is covered with the first insulating layer 30. In the first embodiment, a lower portion of the first insulating layer 30 in the heightwise direction Td that is formed on the second side surface 20D is another first protruding portion 31.

When viewed in the lengthwise direction Ld, the first insulating layer 30 covers an upper portion of the second end surface 20B in the heightwise direction Td. In the heightwise direction Td, an area of the second end surface 20B that is covered with the first insulating layer 30 is widest at the center of the second end surface 20B in the widthwise direction Wd and becomes narrower in the heightwise direction Td with increasing distance from the center of the second end surface 20B in the widthwise direction Wd. A lower end of the first insulating layer 30 in the heightwise direction Td is positioned above the center of the core 20 in the heightwise direction Td at the center of the second end surface 20B in the widthwise direction Wd. In other words, an edge of the area of the second end surface 20B, the area being covered with the first insulating layer 30, is curved so as to protrude toward the lower side in the heightwise direction Td at the center of the second end surface 20B in the widthwise direction Wd.

In addition, the first insulating layer 30 covers an upper portion of the first end surface 20A in the heightwise direction Td. An area of the first end surface 20A that is covered with the first insulating layer 30 is the same as the area of the second end surface 20B that is covered with the first insulating layer 30.

Note that, in the first embodiment, the first end surface 20A, the second end surface 20B, the first side surface 20C, and the second side surface 20D are connected to one another forming edges, and these edges have the same area covered with the first insulating layer 30 in the heightwise direction Td.

A second insulating layer 40 partially covers the surfaces of the core 20. The second insulating layer 40 is made of a material having an insulating property higher than that of the core 20. More specifically, the second insulating layer 40 is made of glass, which is the same as the material of the first insulating layer 30. In the first embodiment, the second insulating layer 40 functions as a second coating layer.

The second insulating layer 40 covers the entire lower side surface 20F, which is one of the four outer peripheral surfaces of the core 20 that are parallel to the central axis CA. In addition, the second insulating layer 40 partially covers the first side surface 20C and the second side surface 20D that are respectively located on the first end side and the second end side in the widthwise direction Wd, the first side surface 20C and the second side surface 20D each being one of the four outer peripheral surfaces of the core 20 and each being adjacent to the lower side surface 20F. Furthermore, the second insulating layer 40 partially covers the first end surface 20A of the core 20, which is located on the first end side in the lengthwise direction Ld, and the second end surface 20B of the core 20, which is located on the second end side in the lengthwise direction Ld.

More specifically, when viewed in the widthwise direction Wd, the second insulating layer 40 covers a lower portion of the first side surface 20C in the heightwise direction Td. In the heightwise direction Td, an area of the first side surface 20C that is covered with the second insulating layer 40 is widest at the center of the first side surface 20C in the lengthwise direction Ld and becomes narrower in the heightwise direction Td with increasing distance from the center of the first side surface 20C in the lengthwise direction Ld. A upper end of the second insulating layer 40 in the heightwise direction Td is positioned above the center of the core 20 in the heightwise direction Td at the center of the first side surface 20C in the lengthwise direction Ld. In other words, an edge of the area of the first side surface 20C, the area being covered with the second insulating layer 40, is curved so as to protrude toward the upper side in the heightwise direction Td at the center of the first side surface 20C in the lengthwise direction Ld. In the first embodiment, an upper portion of the second insulating layer 40 in the heightwise direction Td that is formed on the first side surface 20C is a second protruding portion 41.

The second insulating layer 40 covers an lower portion of the second side surface 20D in the heightwise direction Td. An area of the second side surface 20D that is covered with the second insulating layer 40 is the same as the area of the first side surface 20C that is covered with the second insulating layer 40. In the first embodiment, an upper portion of the second insulating layer 40 in the heightwise direction Td that is formed on the second side surface 20D is another second protruding portion 41.

When viewed in the lengthwise direction Ld, the second insulating layer 40 covers a lower portion of the second end surface 20B in the heightwise direction Td. In the heightwise direction Td, an area of the second end surface 20B that is covered with the second insulating layer 40 is widest at the center of the second end surface 20B in the widthwise direction Wd and becomes narrower in the heightwise direction Td with increasing distance from the center of the second end surface 20B in the widthwise direction Wd. An upper end of the second insulating layer 40 in the heightwise direction Td is positioned below the center of the core 20 in the heightwise direction Td at the center of the second end surface 20B in the widthwise direction Wd. In other words, an edge of the area of the second end surface 20B, the area being covered with the second insulating layer 40, is curved so as to protrude toward the upper side in the heightwise direction Td at the center of the second end surface 20B in the widthwise direction Wd.

In addition, the second insulating layer 40 covers a lower portion of the first end surface 20A in the heightwise direction Td. An area of the first end surface 20A that is covered with the second insulating layer 40 is the same as the area of the second end surface 20B that is covered with the second insulating layer 40.

Note that, in the first embodiment, the edges formed of the first end surface 20A, the second end surface 20B, the first side surface 20C, and the second side surface 20D connected to one another have the same area covered with the second insulating layer 40 in the heightwise direction Td.

A portion of the second insulating layer 40 covers a portion of the first insulating layer 30 on each of the first side surface 20C and the second side surface 20D. Specifically, an end portion of the second protruding portion 41 of the second insulating layer 40 covers an end portion of the first protruding portion 31 of the first insulating layer 30. In other words, the center of the first insulating layer 30 in the lengthwise direction Ld and the center of the second insulating layer 40 in the lengthwise direction Ld coincide with each other on each of the first side surface 20C and the second side surface 20D. Thus, an overlapping region RF in which the first insulating layer 30 and the second insulating layer 40 overlap each other and a non-overlapping region NRF in which the first insulating layer 30 and the second insulating layer 40 do not overlap each other are formed on each of the first side surface 20C and the second side surface 20D. The edge of each of the first protruding portions 31 of the first insulating layer 30 and the edge of each of the second protruding portions 41 of the second insulating layer 40 serve as the boundary between one of the overlapping regions RF and the corresponding non-overlapping region NRF.

Figure 3:
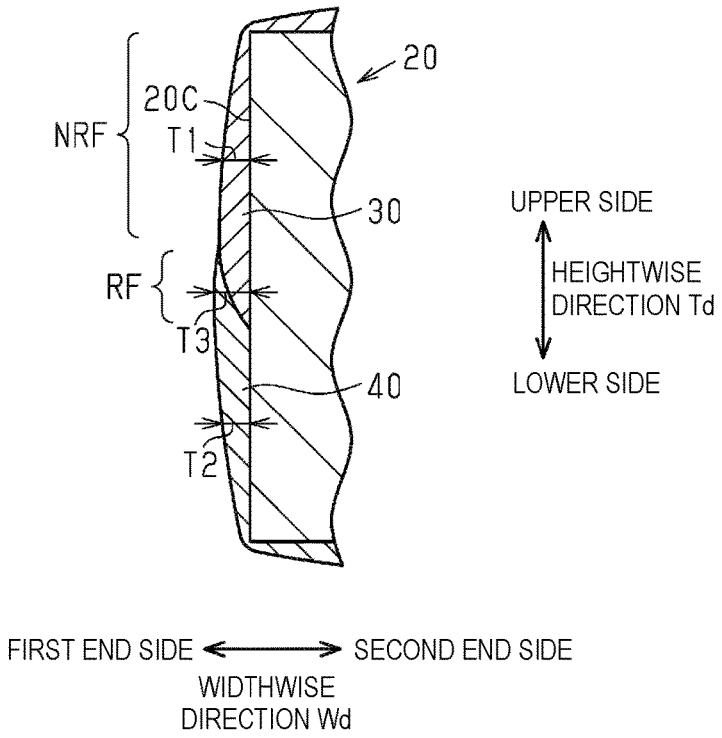
FIG. 3 is a cross-sectional view of the electronic component illustrated in FIG. 1 taken along a one-dot chain line 3.

FIG. 3 illustrates a cross-section taken along the widthwise direction Wd and the heightwise direction Td at the center of the NTC thermistor component 10 in the lengthwise direction Ld and is an enlarged view of one of the overlapping regions RE As illustrated in FIG. 3, in the overlapping region RF on the first side surface 20C, a total thickness T3 that is obtained by adding a thickness T2 of the second insulating layer 40 to a thickness T1 of the first insulating layer 30 is about 1.4 times or more and about 2.7 times or less an average thickness Tlave of the corresponding non-overlapping region NRF that is a portion of the first insulating layer 30 excluding the overlapping region RF and that is located on the same plane, which is the first side surface 20C.

Note that, when comparing with the total thickness T3 of the overlapping region RF of the first side surface 20C, the average thickness Tlave of the first insulating layer 30 is calculated by measuring the thickness T1 of the first insulating layer 30 at a plurality of points in the non-overlapping region NRF, which is not the overlapping region RF, on the first side surface 20C, which is a flat surface including the overlapping region RF. For example, the average thickness Tlave of the first insulating layer 30 is the average value of the thicknesses measured at three points, the three points including a point near the overlapping region RF, a center point between the upper end and the lower end of the non-overlapping region NRF in the heightwise direction Td, and a point near the upper end of the non-overlapping region NRF in the heightwise direction Td.

The total thickness T3 of the overlapping region RF of the first side surface 20C is a dimension obtained by measuring the maximum distance from the first side surface 20C of the core 20 to a surface of the second insulating layer 40, the surface being located on the first end side in the widthwise direction Wd, in the overlapping region RE For example, the total thickness T3 is the dimension when the distance from the first side surface 20C to the surface of the second insulating layer 40, the surface being farthest from the first side surface 20C, is measured by observing with a microscope at a magnification of about 300 times in the cross section perpendicular to the lengthwise direction Ld at the center of the first side surface 20C in the lengthwise direction Ld.

As illustrated in FIG. 1, in the vicinity of the center of the second end surface 20B in the heightwise direction Td, the area covered with the first insulating layer 30 and the area covered with the second insulating layer 40 do not overlap each other. In addition, on the second end surface 20B, an edge of the area covered with the first insulating layer 30 and an edge of the area covered with the second insulating layer 40 are separated from each other. In other words, the second end surface 20B, which is one of the surfaces of the core 20 is partially exposed. A region in the vicinity of the center of the second end surface 20B in the heightwise direction Td is not covered with the first insulating layer 30 or the second insulating layer 40, and the end of the second inner electrode 22B and the end of the fourth inner electrode 22D that are located on the second end side in the lengthwise direction Ld are exposed through this region. In addition, as illustrated in FIG. 2, the end of the first inner electrode 22A and the end of the third inner electrode 22C that are located on the first end side in the lengthwise direction Ld are exposed at the first end surface 20A. Note that the ends of the first inner electrode 22A and the ends of the third inner electrode 22C that are located on the first end side in the lengthwise direction Ld and the ends of the second inner electrode 22B and the ends of the fourth inner electrode 22D that are located on the second end side in the lengthwise direction Ld are portions of the end portions of the inner electrodes. Consequently, these portions of the end portions of the inner electrodes function as exposed portions EP that are exposed without being covered with the first insulating layer 30 or the second insulating layer 40. Note that, in the present specification, it is only necessary for the exposed portions EP to be exposed at the surfaces of the core 20 without being covered with the first insulating layer 30 or the second insulating layer 40, and may be covered with a first outer electrode 50A and a second outer electrode 50B, which will be described below.

As illustrated in FIG. 1, the first outer electrode 50A is formed on portions of the surfaces of the core 20, the portions being located on the first end side in the lengthwise direction Ld. the first outer electrode 50A covers a portion of the core 20, the portion extending from the first end of the core 20 to a position between the first end of the overlapping region RF and the center of the core 20 in the lengthwise direction Ld. In other words, the first outer electrode 50A covers all the portions of the surfaces of the core 20 that are located between the first end of the core 20 and the center of the core 20 in the lengthwise direction Ld and that are not covered with the first insulating layer 30 or the second insulating layer 40. Note that, although not illustrated in FIG. 1, the first outer electrode 50A includes a first base electrode 51A, which is laminated on the surfaces of the core 20, and a first plating layer 52A, which is laminated on the surface of the first base electrode 51A.

The second outer electrode 50B is formed on portions of the surfaces of the core 20, the portions being located on the second end side in the lengthwise direction Ld. The second outer electrode 50B has a configuration the same as that of the first outer electrode 50A except that the second outer electrode 50B is located on the second end side of the core 20 in the lengthwise direction Ld. Although not illustrated in FIG. 1, the second outer electrode 50B is formed by laminating a second base electrode 51B, which is laminated on the surfaces of the core 20, and a second plating layer 52B, which is laminated on the surface of the second outer electrode 50B.

A method of manufacturing the NTC thermistor component 10 will now be described.

The method of manufacturing the NTC thermistor component 10 includes a core preparation step, a first coating application step, a second coating application step, a conductor application step, a curing step, and a plating step.

First, in the core preparation step, a plurality of ceramic layers are laminated together with the inner electrodes 22 sandwiched therebetween such that the end portions of the internal electrodes 22 are partially exposed at the surfaces of the core 20, so that the internal electrodes 22 are arranged inside the core 20. Then, the plurality of ceramic layers and the internal electrodes 22 are pressure-bonded together so as to form a green ceramic multilayer body. After that, the ceramic multilayer body is fired, so that the core 20 is formed.

Figure 4:
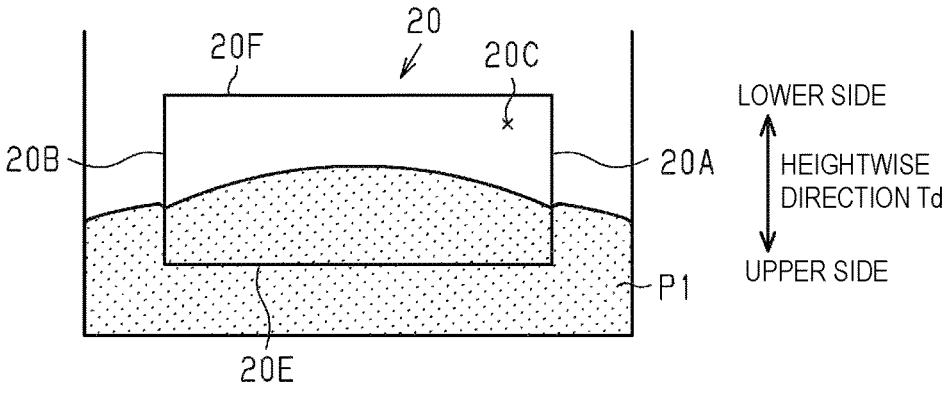
FIG. 4 is a diagram illustrating a first coating application step of the first embodiment.

After the core preparation step, the first coating application step is performed. As illustrated in FIG. 4, in the first coating application step, a sol P1 that contains metal alkoxide is applied to the upper side of the core 20 in the heightwise direction Td. More specifically, an adhesive plate is attached to the lower side surface 20F of the core 20, which is located on the lower side in the heightwise direction Td, and the adhesive plate is held so as to hold the entire core 20. Then, the position of the core 20 is adjusted such that the upper portion of the core 20 faces toward the lower side in the heightwise direction Td, and only approximately one-third of the upper portion of the core 20 in the heightwise direction Td is immersed, or in other words dipped, in the sol P1. The sol P1 is applied along the first end surface 20A, the second end surface 20B, the first side surface 20C, and the second side surface 20D, each of which is one of the surfaces of the core 20, such that the sol P1 extends toward the lower side in the heightwise direction Td with increasing distance from the corners of the core 20. In other words, on each of the first end surface 20A and the second end surface 20B, an edge of the area that is coated with the sol P1 forms a substantially arc shape protruding such that the center of the edge in the widthwise direction Wd is located at the lowest position in the heightwise direction Td. In addition, on each of the first side surface 20C and the second side surface 20D, an edge of the area that is coated with the sol P1 forms a substantially arc shape protruding such that the center of the edge in the lengthwise direction Ld is located at the lowest position in the heightwise direction Td. The lower edges of the areas of the first side surface 20C and the second side surface 20D, the areas being coated with the sol P1, are positioned further toward the lower side than the lower edges of the areas of the first end surface 20A and the second end surface 20B, the areas being coated with the sol P1, are. In addition, the lower edges of the areas of the first end surface 20A and the second end surface 20B, the areas being coated with the sol P1, are positioned above the center of the core 20 in the heightwise direction Td. Subsequently, the sol P1 applied to the core 20 is dried.

Note that the sol P1 is a sol in a solution state. When the sol is dried, it becomes a gel that has a viscosity higher than that of the sol, and when the gel is further dried, the gel becomes solidified. Note that the sol P1 is not limited to containing metal alkoxide and may contain an inorganic salt, a metal organic-acid salt, or a metal-organic complex. In addition, the sol P1 that is applied in the first coating application step forms the first insulating layer 30 containing silicon oxide in the curing step which will be described later.

Figure 5:
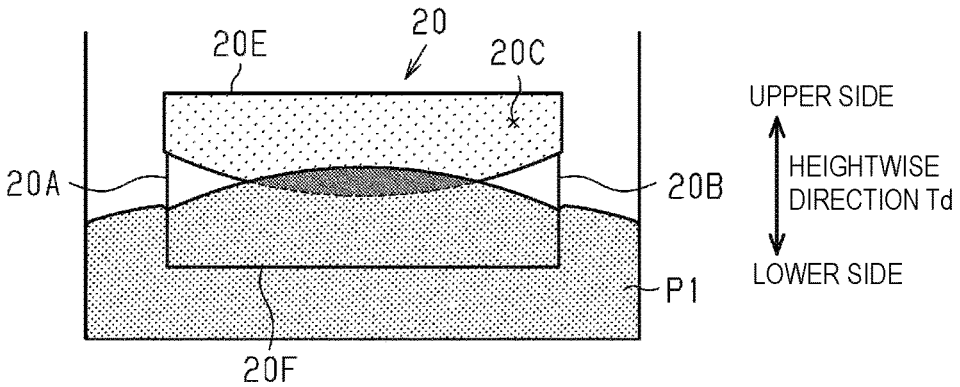
FIG. 5 is a diagram illustrating a second coating application step of the first embodiment.

After the first coating application step, the second coating application step is performed. As illustrated in FIG. 5, in the second coating application step, the sol P1 is applied to the lower side of the core 20 in the heightwise direction Td. More specifically, an adhesive plate is attached to the upper side surface 20E of the core 20, which is located on the upper side in the heightwise direction Td, and the adhesive plate is held so as to hold the entire core 20. Then, the position of the core 20 is adjusted such that the lower portion of the core 20 faces toward the lower side in the heightwise direction Td, and only approximately one-third of the lower portion of the core 20 in the heightwise direction Td is immersed, or in other words dipped, in the sol P1. The sol P1 is applied along the first end surface 20A, the second end surface 20B, the first side surface 20C, and the second side surface 20D, each of which is one of the surfaces of the core 20, such that the sol P1 extends toward the upper side in the heightwise direction Td with increasing distance from the corners of the core 20. In other words, on each of the first end surface 20A and the second end surface 20B, an edge of the area that is coated with the sol P1 in the second coating application step forms a substantially arc shape protruding such that the center of the edge in the widthwise direction Wd is located at the highest position in the heightwise direction Td. In addition, on each of the first side surface 20C and the second side surface 20D, an edge of the area that is coated with the sol P1 in the second coating application step forms a substantially arc shape protruding such that the center of the edge in the lengthwise direction Ld is located at the highest position in the heightwise direction Td. The upper edge of the area of the first side surface 20C and the upper edge of the area of the second side surface 20D, the areas being coated with the sol P1 in the second coating application step, are positioned further toward the upper side than the upper edge of the area of the first end surface 20A and the upper edge of the area of the second end surface 20B, the areas being coated with the sol P1 in the second coating application step, are. In addition, the upper edge of the area of the first side surface 20C and the upper edge of the area of the second side surface 20D, the areas being coated with the sol P1 in the second coating application step, are positioned further toward the upper side than the lower edge of the area of the first side surface 20C and the lower edge of the area of the second side surface 20D, the areas being coated with the sol P1 in the first coating application step, are. As a result, the sol P1 applied to the first side surface 20C in the first coating application step and the sol P1 applied to the first side surface 20C in the second coating application step overlap each other, and the sol P1 applied to the second side surface 20D in the first coating application step and the sol P1 applied to the second side surface 20D in the second coating application step overlap each other. In addition, the upper edge of the area of the first end surface 20A and the upper edge of the area of the second end surface 20B, the areas being coated with the sol P1 in the second coating application step, are positioned below the center of the core 20 in the heightwise direction Td. As a result, as illustrated in FIG. 1, the portions of the inner electrodes 22 that are exposed at the surfaces of the core 20 are only partially covered with the sol P1, so that the exposed portions EP are formed. In other words, in the first coating application step, the sol P1 is applied such that the portions of the inner electrodes 22 that are exposed at the surfaces of the core 20 are not entirely coated with the sol P1. In addition, in the second coating application step, the sol P1 is applied such that the portions of the inner electrodes 22 that are exposed at the surfaces of the core 20 and that are not coated with the sol P1 in the first coating application step are not entirely coated with the sol P1, so that the exposed portions EP are formed. Subsequently, the sol P1 applied to the core 20 in the second coating application step is dried. Note that the sol P1 applied in the second coating application step forms the second insulating layer 40 containing silicon oxide in the curing step which will be described later.

After the second coating application step, the conductor application step is performed. In the conductor application step, the position of the core 20 is adjusted such that the first end of the core 20 in the lengthwise direction Ld faces downward, and a conductor sol that contains metal alkoxide is applied to the portion of the core 20 that is located on the first end side in the lengthwise direction Ld and on which the first outer electrode 50A is to be formed. In the curing step, which will be described below, the applied conductor sol forms the first base electrode 51A that contains silicon oxide and silver, which is a conductor. Subsequently, the conductor sol applied to the core 20 is dried. Then, the position of the core 20 is adjusted such that the second end of the core 20 in the lengthwise direction Ld faces downward, and the conductor sol is applied to the portion of the core 20 that is located on the second end side in the lengthwise direction Ld and on which the second outer electrode 50B is to be formed. The applied conductor sol forms the second base electrode 51B that contains silicon oxide and silver, which is a conductor, in the curing step, which will be described below.

After the conductor application step, the curing step is performed. More specifically, the curing step in the first embodiment is a heating step. In the heating step, the core 20 to which the sol P1 and the conductor sol have been applied is heated. As a result, the first insulating layer 30 and the second insulating layer 40 each of which partially covers the surfaces of the core 20 are fired, and the first base electrode 51A and the second base electrode 51B are fired. In other words, in the heating step, the sol P1 is cured, so that the first insulating layer 30 and the second insulating layer 40 are formed, and the conductor sol is cured, so that the first base electrode 51A and the second base electrode 51B are formed.

After the heating step, the plating step is performed. In the plating step, electroplating is performed by immersing, or in other words dipping, in a plating solution, the portion of the core 20 on which the first base electrode 51A has been formed and the portion of the core 20 on which the second base electrode 51B has been formed. As a result, the first plating layer 52A is formed on the surface of the first base electrode 51A, and the second plating layer 52B is formed on the surface of the second base electrode 51B. The first plating layer 52A formed in the manner described above forms the first outer electrode 50A together with the first base electrode 51A. The second plating layer 52B forms the second outer electrode 50B together with the second base electrode 51B.

Advantageous effects of the above-described first embodiment will now be described.

(1) According to the above-described first embodiment, in the first coating application step, a portion of the surfaces of the core 20 to which the sol P1 for forming the first insulating layer 30 is not applied can be held. Similarly, in the second coating application step, a portion of the surfaces of the core 20 to which the sol P1 for forming the second insulating layer 40 is not applied or a portion of the surfaces of the core 20 on which the sol P1 applied thereto has already been dried can be held. Thus, when the NTC thermistor component 10 is manufactured, the core 20 is held at portions thereof that do not have the undried sol P1 deposited thereon, and thus, the sol P1 does not adhere to an adhesive plate, which is a holder for holding the core 20, or only a small amount of the sol P1 may adhere to the adhesive plate. Therefore, the time and effort needed for cleaning or replacing the adhesive plate, which is a holder for holding the core 20, can be saved, and this can contribute to simplification of the manufacturing method and an improvement in the manufacturing efficiency.

(2) According to the above-described first embodiment, the overlapping region RF in which the first insulating layer 30 and the second insulating layer 40 overlap each other are formed on some of the surfaces of the core 20. Forming the overlapping region RF increases the whole thickness of the insulating layers to be larger than that in the case where the overlapping region RF is not formed, and thus, an improvement in the entire strength of the NTC thermistor component 10 can be expected.

(3) According to the above-described first embodiment, in each of the overlapping regions RF, the total thickness T3, which is obtained by adding the thickness T2 of the second insulating layer 40 to the thickness T1 of the first insulating layer 30, is about 1.4 times or more the average thickness Tlave of the first insulating layer 30 in the non-overlapping region NRF. The fact that the total thickness T3 is set in this manner implies that the first insulating layer 30 and the second insulating layer 40 have adequately large overlapping regions RE Consequently, the overlapping region RF can be formed with higher certainty even if manufacturing errors occur in the first coating application step and the second coating application step, which cause errors of the application areas of the sol P1.

(4) According to the above-described first embodiment, in the overlapping region RF, the total thickness T3, which is obtained by adding the thickness T2 of the second insulating layer 40 to the thickness T1 of the first insulating layer 30, is about 2.7 times or less the average thickness T1ave of the first insulating layer 30 in the non-overlapping region NRF. Thus, the NTC thermistor component 10 can be prevented from being locally increased in size due to the total thickness T3 which is excessively large.

(5) According to the above-described first embodiment, the entire surfaces of the core 20 are covered with the first insulating layer 30, the second insulating layer 40, the first base electrode 51A, and the second base electrode 51B. Accordingly, the core 20 is not brought into contact with the plating solution in the plating step. Therefore, the core 20 does not dissolve in the plating solution during electroplating.

(6) According to the above-described first embodiment, the first ends of the first inner electrode 22A and the third inner electrode 22C in the lengthwise direction Ld and the second ends of the second inner electrode 22B and the fourth inner electrode 22D in the lengthwise direction Ld function as the exposed portions EP, which are exposed without being covered with the first insulating layer 30 or the second insulating layer 40. Thus, the first inner electrode 22A is reliably connected to the first outer electrode 50A, and the electrical connection between them is not hindered by the first insulating layer 30 or the second insulating layer 40.

(7) According to the above-described first embodiment, on each of the first side surface 20C and the second side surface 20D, the edge of the first insulating layer 30 is curved so as to protrude toward the lower side in the heightwise direction Td at the center thereof in the lengthwise direction Ld. In addition, on each of the first side surface 20C and the second side surface 20D, the edge of the second insulating layer 40 is curved so as to protrude toward the upper side in the heightwise direction Td at the center thereof in the lengthwise direction Ld. The center of the first insulating layer 30 and the center of the second insulating layer 40 in the lengthwise direction Ld coincide with each other. Thus, the overlapping region RF may be easily formed at the protruding tip end portion of each of the insulating layers, and areas that are not covered with any of the insulating layers may be easily formed at the protruding two end portions of each of the insulating layers in the lengthwise direction Ld. In other words, in the above-described first embodiment, formation of the overlapping regions RF and formation of the exposed portions EP of the inner electrodes 22 are both achieved.

(8) According to the above-described first embodiment, the inner electrodes 22 are exposed at the first end surface 20A and the second end surface 20B among the surfaces of the core 20, which is in the shape of a substantially square prism. Since the core 20 is in the shape of a substantially square prism and is longer in the lengthwise direction Ld than in the widthwise direction Wd, when the surfaces of the core 20 are immersed, or in other words dipped, in the sol P1 by the same area in the heightwise direction Td, the lower end of the area to which the sol P1 is applied on each of the first end surface 20A and the second end surface 20B is differs from the lower end of the area to which the sol P1 is applied on each of the first side surface 20C and the second side surface 20D in the heightwise direction Td. Thus, the overlapping regions RF are formed on the first side surface 20C and the second side surface 20D, and the areas that are not covered with the first insulating layer 30 or the second insulating layer 40 can be formed on the first end surface 20A and the second end surface 20B. Consequently, the inner electrodes 22 are exposed at the first end surface 20A and the second end surface 20B among the surfaces of the core 20, which is in the shape of a substantially square prism, and thus, the exposed portions EP may be easily formed.

(9) According to the above-described first embodiment, the first insulating layer 30, the second insulating layer 40, the first base electrode 51A, and the second base electrode 51B contain silicon as a common inorganic component. Thus, when the sol P1 and the conductor sol are sintered, they can be sintered under the same heating conditions. Therefore, by sintering the first insulating layer 30, the second insulating layer 40, the first base electrode 51A, and the second base electrode 51B in one heating step without having separate heating steps, the number of steps can be reduced.

Second Embodiment

Next, an electronic component and a method of manufacturing an electronic component according to a second embodiment will be described. Note that, in the following description of the second embodiment, components similar to those in the first embodiment are denoted by the same reference signs, and specific descriptions thereof will be omitted or simplified.

Figure 6:
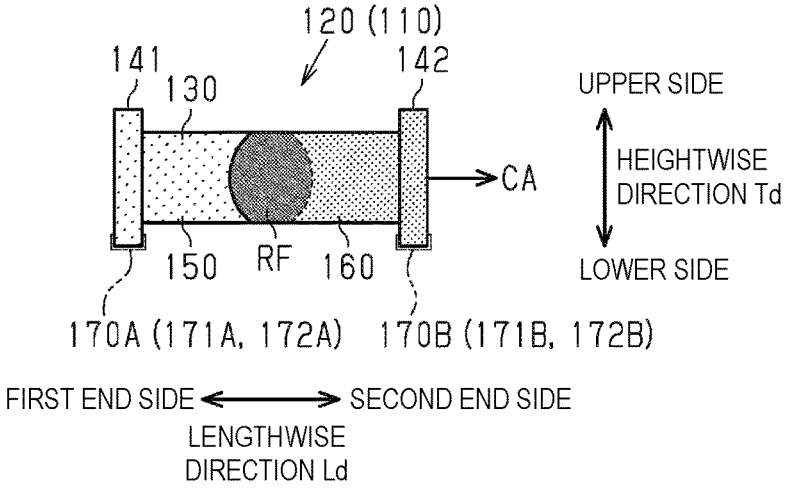
FIG. 6 is a side view of an electronic component of a second embodiment.

First, a core 120 that is a component body of the electronic component and is a wire-wound inductor component will be described. As illustrated in FIG. 6, for example, the core 120, which is the component body of the electronic component and is a wire-wound inductor component, is a component body of a surface mount inductor component that is mounted onto a circuit board or the like. The core 120 is made of a magnetic material such as nickel-zinc-based ferrite. The core 120 is formed by firing a compact that is obtained by compressing the above-mentioned magnetic material, which is powder.

The core 120 includes a winding core portion 130 that is in the form of a substantially square prism, a first flange portion 141 that is connected to a first end of the winding core portion 130 in a direction in which the central axis CA extends, and a second flange portion 142 that is connected to a second end of the winding core portion 130 in the direction in which the central axis CA extends. Note that, in the following description, the direction in which the central axis CA of the winding core portion 130 extends will be referred to as the lengthwise direction Ld. A direction that is perpendicular to the lengthwise direction Ld and along one of the four outer peripheral surfaces of the winding core portion 130 will be referred to as the widthwise direction Wd. A direction that is perpendicular to the lengthwise direction Ld and the widthwise direction Wd will be referred to as the heightwise direction Td.

The first flange portion 141 has a substantially flat rectangular parallelepiped shape having a small dimension in the lengthwise direction Ld. When viewed in the lengthwise direction Ld, the first flange portion 141 has a substantially square shape. In addition, when viewed in the lengthwise direction Ld, each side of the substantially square shape of the first flange portion 141 is parallel to a corresponding one of the outer peripheral surfaces of the winding core portion 130. The center of gravity of the first flange portion 141 coincides with the central axis CA of the winding core portion 130 when viewed in the lengthwise direction Ld. The first flange portion 141 is larger in size than the winding core portion 130 when viewed in the lengthwise direction Ld. In other words, outer peripheral portions of the first flange portion 141 each protrude further outward than a corresponding one of the outer peripheral surfaces of the winding core portion 130 does. The second flange portion 142 has a configuration the same as that of the first flange portion 141 except that the second flange portion 142 is connected to the second end of the winding core portion 130.

The surfaces of the core 120 are partially covered with a first insulating layer 150. The first insulating layer 150 is made of a material having an insulating property higher than that of the core 120. More specifically, the first insulating layer 150 is made of glass that contains silicon oxide as a main component. In the second embodiment, the first insulating layer 150 functions as the first coating layer.

The first insulating layer 150 covers the entire surface of the first flange portion 141 among the surfaces of the core 120. In addition, the first insulating layer 150 covers portions of the outer peripheral surfaces of the winding core portion 130, the portions extending from the first end of the winding core portion 130 in the lengthwise direction Ld to a position between the center of the winding core portion 130 and the second end of the winding core portion 130 in the lengthwise direction Ld.

More specifically, in the lengthwise direction Ld, the area of each of the outer peripheral surfaces of the winding core portion 130, the area being covered with the first insulating layer 150, is widest at the center of the surface in the transverse direction and becomes narrower in the lengthwise direction Ld with increasing distance from the center of the surface in the transverse direction. In other words, an edge of the area of each of the outer peripheral surfaces of the winding core portion 130, the area being covered with the first insulating layer 150, is curved so as to protrude toward the second end side in the lengthwise direction Ld at the center thereof in the transverse direction.

The surfaces of the core 120 are partially covered with a second insulating layer 160. The second insulating layer 160 is made of a material that has an insulating property higher than that of the core 120 and that is the same material as the first insulating layer 150. More specifically, the second insulating layer 160 covers the entire surface of second flange portion 142. In addition, the second insulating layer 160 covers portions of the outer peripheral surfaces of the winding core portion 130, the portions extending from the second end of the winding core portion 130 in the lengthwise direction Ld to a position between the center of the winding core portion 130 and the first end of the winding core portion 130 in the lengthwise direction Ld. In the second embodiment, the second insulating layer 160 functions as the second coating layer.

More specifically, in the lengthwise direction Ld, the area of each of the outer peripheral surfaces of the winding core portion 130, the area being covered with the second insulating layer 160, is widest at the center of the surface in the transverse direction and becomes narrower in the lengthwise direction Ld with increasing distance from the center of the surface in the transverse direction. In other words, an edge of the area of each of the outer peripheral surfaces of the winding core portion 130, the area being covered with the second insulating layer 160, is curved so as to protrude toward the first end side in the lengthwise direction Ld at the center thereof in the transverse direction.

As a result of the first insulating layer 150 and the second insulating layer 160 covering the surfaces of the core 120, the overlapping region RF in which the first insulating layer 150 and the second insulating layer 160 overlap each other is formed near the center of the winding core portion 130 in the lengthwise direction Ld. The overlapping region RF has a substantially continuous annular shape extending along the surfaces of the winding core portion 130 of the core 120.

A first outer electrode 170A is laminated on the surface of the first insulating layer 150 on a portion of the first flange portion 141, the portion being positioned further toward the lower side in the heightwise direction Td than the winding core portion 130 is. The first outer electrode 170A covers approximately one-third of the portion of the first flange portion 141, the portion being located at a position lower than the winding core portion 130, from the lower side. Note that, although not illustrated in FIG. 6, the first outer electrode 170A includes a first base electrode 171A, which is laminated on the surfaces of the core 120, and a first plating layer 172A, which is laminated on the surface of the first base electrode 171A.

A second outer electrode 170B is laminated on the surface of the second insulating layer 160 on a portion of the second flange portion 142, the portion being positioned further toward the lower side in the heightwise direction Td than the winding core portion 130 is. The second outer electrode 170B has a configuration the same as that of the first outer electrode 170A except that the second outer electrode 170B is provided on the second flange portion 142. In addition, although not illustrated in FIG. 6, the second outer electrode 170B includes a second base electrode 171B, which is laminated on the surfaces of the core 120, and a second plating layer 172B, which is laminated on the surface of second base electrode 171B. Note that the first outer electrode 170A and the second outer electrode 170B are each connected to an end of a winding (not illustrated).

As described above, the first insulating layer 150 covers the entire surface of the first flange portion 141 and the portions of the surfaces of the winding core portion 130, each of the portions being located on the first end side in the length direction Ld and being approximately two-thirds of the entire length of the winding core portion 130 in the length direction Ld. Thus, the first insulating layer 150 also covers a connecting portion in which the outer peripheral surfaces of the winding core portion 130 are connected to the portions of the first flange portion 141 that protrude outward from the outer peripheral surfaces of the winding core portion 130. When the core 120 is viewed in the cross section including the central axis CA of the winding core portion 130, the curvature of the surface of a portion of the first insulating layer 150, the portion covering this connecting portion, is smaller than the curvature of the connecting portion. Similarly, the second insulating layer 160 also covers a connecting portion in which the outer peripheral surfaces of the winding core portion 130 are connected to the portions of the second flange portion 142 that protrude outward from the outer peripheral surfaces of the winding core portion 130. When the core 120 is viewed in the cross section including the central axis CA of the winding core portion 130, the curvature of the surface of a portion of the second insulating layer 160, the portion covering this connecting portion, is smaller than the curvature of the connecting portion. In the second embodiment, the curvatures are measured by observing with a microscope at a magnification of about 300 times after polishing has been performed on a cross section that includes the connecting portions of the NTC thermistor component 10 and that is perpendicular to the widthwise direction Wd. Then, the curvature of each of the connecting portions is the average value of data items obtained through measurement performed at three points in the observation field of view in the cross section that is perpendicular to the widthwise direction Wd.

In addition, the thickness of the first insulating layer 150 at the connecting portion, in which the outer peripheral surfaces of the winding core portion 130 are connected to the portions of the first flange portion 141 that protrude outward from the outer peripheral surfaces of the winding core portion 130 is larger than the thickness of the first insulating layer 150 that is positioned between the first base electrode 171A and the lower side surface of the first flange portion 141. In the second embodiment, the thickness of each layer is measured by observing with a microscope at a magnification of about 300 times after polishing has been performed on a cross section of the NTC thermistor component 10. The thickness of the first insulating layer 150 is the average value of data items obtained through measurement performed at three points in the observation field of view.

Next, a method of manufacturing an inductor component will be described.

The method of manufacturing an inductor component includes the core preparation step, the first coating application step, the second coating application step, the conductor application step, the curing step, and the plating step.

First, in the core preparation step, the core 120 is formed by firing a compact that is obtained by compressing a powdery magnetic material. In the second embodiment, when the core 120 is formed by using a metal mold, the winding core portion 130, the first flange portion 141, and the second flange portion 142 are formed.

Figure 7:
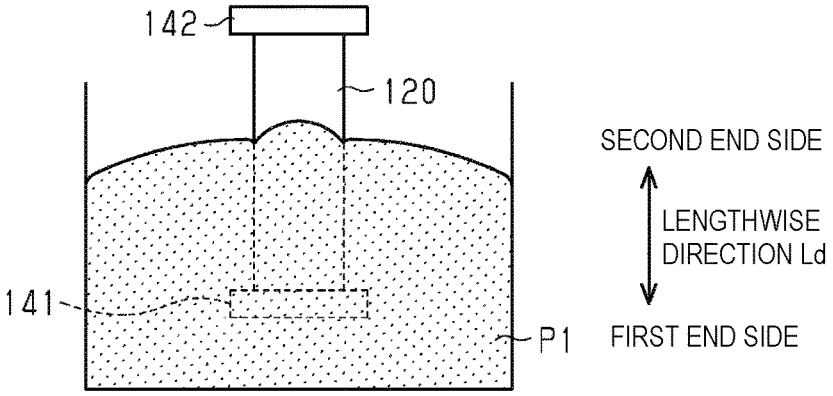
FIG. 7 is a diagram illustrating a first coating application step of the second embodiment.

After the core preparation step, the first coating application step is performed. As illustrated in FIG. 7, in the first coating application step, the sol P1 that contains metal alkoxide is applied to the first end side of the core 120 in the lengthwise direction Ld. More specifically, a portion of the winding core portion 130 that extends from the first end of the winding core portion 130 to a position on the second end side of the winding core portion 130 in the lengthwise direction Ld so as to have a dimension approximately two-thirds of the dimension the winding core portion 130 in the lengthwise direction Ld is immersed, or in other words dipped, in the sol P1. Note that the sol P1 applied in the first coating application step forms the first insulating layer 150 that contains silicon oxide in the curing step which will be described later. Subsequently, the sol P1 applied to the core 120 is dried.

Figure 8:
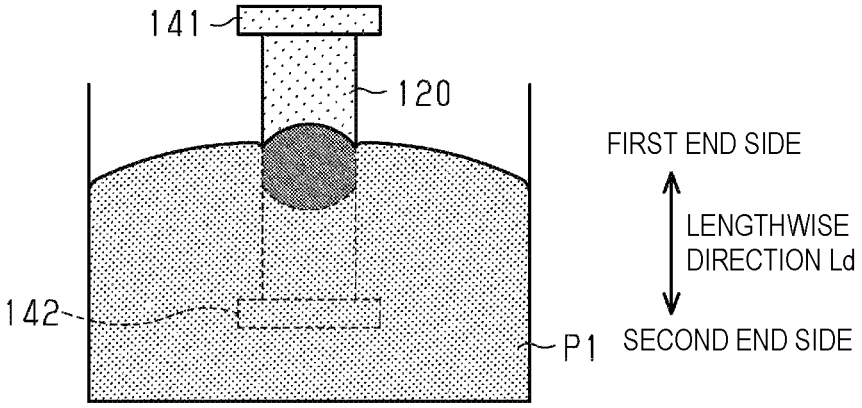
FIG. 8 is a diagram illustrating a second coating application step of the second embodiment.

After the first coating application step, the second coating application step is performed. As illustrated in FIG. 8, in the second coating application step, the sol P1 is applied to the second end side of the core 120 in the lengthwise direction Ld. More specifically, a portion of the winding core portion 130 that extends from the second end of the winding core portion 130 to a position on the first end side of the winding core portion 130 in the lengthwise direction Ld so as to have a dimension approximately two-thirds of the winding core portion 130 and is immersed, or in other words dipped, in the sol P1. Note that the sol P1 applied in the second coating application step forms the second insulating layer 160 that contains silicon oxide in the curing step which will be described later. Subsequently, the sol P1 applied to the core 120 is dried.

After the second coating application step, the conductor application step is performed. In the conductor application step, a conductor sol that contains metal alkoxide is applied to a portion of the first flange portion 141 of the core 120 on which the first outer electrode 170A is to be formed and a portion of the second flange portion 142 of the core 120 on which the second outer electrode 170B is to be formed. In the curing step, which will be described below, the applied conductor sol forms the first base electrode 171A and the second base electrode 171B each of which contains silicon oxide and silver, which is a conductor.

After the conductor application step has been performed, in the curing step, the first insulating layer 150 and the second insulating layer 160, each of which partially covers the surfaces of the core 120, are fired, and the first base electrode 171A and the second base electrode 171B are fired.

After the curing step, the plating step is performed. In the plating step, the first plating layer 172A is formed on the surface of the first base electrode 171A, and the second plating layer 172B is formed on the surface of the second base electrode 171B. Then, a winding is wound around the core 120, so that the wire-wound inductor component can be manufactured.

Advantageous effects of the above-described second embodiment will now be described. In addition to the above-described advantageous effects (1) to (4) and (9) of the first embodiment, the following advantageous effects are obtained.

(10) According to the above-described second embodiment, the entire surfaces of the core 120 are covered with the first insulating layer 150 and the second insulating layer 160. Thus, fine scratches and cracks on the surfaces of the core 120 are filled with the first insulating layer 150 and the second insulating layer 160, and an improvement in the strength of the inductor component can be expected. Note that, when the first insulating layer 150 and the second insulating layer 160 are integrated into one insulating layer, the entire surfaces of the core 120 are covered with the one insulating layer. However, each of the first insulating layer 150 and the second insulating layer 160 partially covers the surfaces of the core 120.

(11) In the above-described second embodiment, the connecting portion in which the winding core portion 130 and the first flange portion 141 are connected to each other has a substantially angular shape, and stress is likely to concentrate at this connecting portion. According to the above-described second embodiment, since the first insulating layer 150 covers the connecting portion, the strength is improved. In addition, the curvature of the surface of a portion of the first insulating layer 150, the portion covering this connecting portion, is smaller than the curvature of the connecting portion when viewed in a cross section including the central axis CA of the winding core portion 130. Thus, an external force that acts on the connecting portion may easily be dispersed. Therefore, the inductor component can be prevented from breaking at the connecting portion.

The above-described embodiments can be implemented by making modifications in the following manner. The above-described embodiments and the following modifications can be combined and implemented as long as it is technically consistent.

In the above-described first embodiment, the areas covered with the first insulating layer 30 and the second insulating layer 40 are not limited to those described as examples in the above-described first embodiment. For example, in the first embodiment, the upper end of the second insulating layer 40 on the first end surface 20A may be positioned above the lower end of the first insulating layer 30 on the first end surface 20A, and the upper end of the second insulating layer 40 on the second end surface 20B may be positioned above the lower end of the first insulating layer 30 on the second end surface 20B. In this case, each of the first end surface 20A and the second end surface 20B also has the overlapping region RF.

Figure 9:
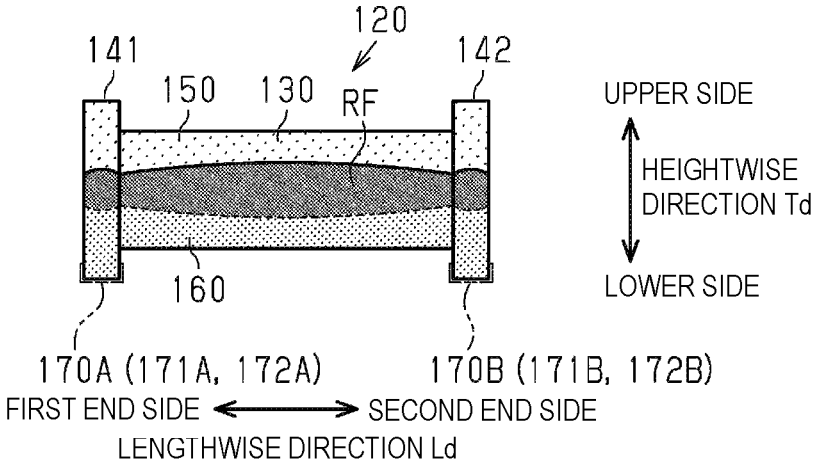
FIG. 9 is a side view of an electronic component of a modification of the second embodiment.

In the above-described second embodiment, the areas covered with the first insulating layer 150 and the second insulating layer 160 are not limited to those described as examples in the above-described second embodiment. For example, as illustrated in FIG. 9, the first insulating layer 150 may partially cover the upper side of the core 120 in the heightwise direction Td, and the second insulating layer 160 may partially cover the lower side of the core 120 in the heightwise direction Td. In this case, each of the overlapping regions RF is located near the center of the core 120 in the heightwise direction Td. In addition, in the manufacturing method of this case, the sol P1 is applied to the upper side of the core 120 in the heightwise direction Td in the first coating application step, and the sol P1 is applied to the lower side of the core 120 in the heightwise direction Td in the second coating application step.

In each of the above-described embodiments, the total thickness T3 of each of the overlapping regions RF is not limited to that described as an example in the above-described first embodiment. For example, the thickness of each of the overlapping regions RF may be less than about 1.4 times the average thickness Tlave of the first insulating layer or may be more than about 2.7 times the average thickness T1ave of the first insulating layer. The thickness of each of the overlapping regions RF may be suitably designed by taking into consideration the shape and the dimensions of the core, the area sizes required for the overlapping regions RF, and so forth. Note that, in each of the overlapping regions RF, the boundary between the first insulating layer and the second insulating layer may be undetermined.

In the above-described first embodiment, the exposed portions EP of the inner electrodes 22 are not necessarily located at the two ends of each of the inner electrodes 22 in the lengthwise direction Ld. For example, any one of four outer peripheral surfaces of each of the inner electrodes 22 that are parallel to one another in the lengthwise direction Ld may have one of the exposed portions EP. In addition, portions of the inner electrodes 22 that are not the end surfaces of the inner electrodes 22 in the lengthwise direction Ld may be exposed.

In the above-described first embodiment, each of the inner electrodes 22 may have any shape as long as the electrical connection between the inner electrode 22 and a corresponding one of the first outer electrode 50A and the second outer electrode 50B can be ensured. In addition, the number of the inner electrodes 22 is not particularly limited and may be two or three or may be five or more.

In the above-described first embodiment, the inner electrodes 22 are not necessarily exposed at the surfaces of the core 20.

In the above-described first embodiment, the surfaces of the core 20 may have a portion that is exposed without being covered with any of the first insulating layer 30, the second insulating layer 40, the first base electrode MA, and the second base electrode 51B.

In the above-described first embodiment, the exposed portions EP may be formed by a different method. For example, the surfaces of the core 20 may be partially covered with the first insulating layer 30 once, and then the surfaces of the first insulating layer 30 may be shaved so as to expose portions of the inner electrodes 22.

In the above-described first embodiment, the shapes of the edges of the first insulating layer 30 are not limited to those described as examples in the above-described first embodiment. For example, each of the edges of the first insulating layer 30 may have a substantially linear shape and does not need to have the first protruding portion. The shapes of the edges of the first insulating layer 30 may be changed depending on a physical property of the sol P1, the method of applying the insulating layer to the core 20, or the like. This is common to the shapes of the edges of the second insulating layer 40 and is also common to the shapes of the edges of the first insulating layer 150 and the shapes of the edges of the second insulating layer 160 in the second embodiment.

In the above-described first embodiment, the shapes of the edges of the first base electrode 51A and the shapes of the edges of the second base electrode 51B on the outer peripheral surfaces of the core 20 may each be curved so as to protrude toward the center of the core 20 in the lengthwise direction Ld.

In each of the embodiments, the material relationship between the sol P1 and the conductor sol is not limited to those described as examples in the above-described embodiments. For example, in the first embodiment, the material of the first insulating layer 30 and the second insulating layer 40 may be a glass component containing titanium dioxide, and the material of the first base electrode 51A and the second base electrode 51B may be a component containing titanium dioxide and silver. In this case, titanium is the common inorganic component. In addition, the material of the first insulating layer 30 and the second insulating layer 40 and the material of the first base electrode 51A and the second base electrode 51B do not need to contain a common inorganic component.

In the above-described first embodiment, the materials of the first insulating layer 30, the second insulating layer 40, the first base electrode 51A, and the second base electrode 51B are not limited to those mentioned as examples in the above-described first embodiment. The material of the first insulating layer 30 and the material of the second insulating layer 40 may be, for example, crystalline glass, a resin, an inorganic oxide, or a ceramic. In addition, the material of the first insulating layer 30 and the material of the second insulating layer 40 may be different from each other. The material of the first base electrode 51A may be any material as long as electricity flows therethrough, and as long as the first plating layer 52A is laminated on the first base electrode 51A in the plating step. For example, the material of the first base electrode 51A may be only silver or may contain copper. Alternatively, the material of the first base electrode 51A may be a mixture of a resin and a metal. The material of the first base electrode 51A and the material of the second base electrode 51B may be different from each other. This is common to the second embodiment.

In the above-described first embodiment, the first coating layer and the second coating layer are not limited to the first insulating layer 30 and the second insulating layer 40. For example, the surfaces of the component body may be coated with a material having a hardness larger than that of the component body. In addition, in the case where the component body has a relatively large number of voids, providing the first coating layer and the second coating layer makes it difficult for a liquid to enter the component body.

In the above-described second embodiment, the curvature of the first insulating layer 30 covering the connecting portion in which the winding core portion 130 and the first flange portion 141 are connected to each other may be the same as the curvature of this connecting portion of the core 120.

In the above-described first embodiment, the first plating layer 52A does not need to have a three-layer structure. In addition, the material of the first plating layer 52A may be any material as long as the first plating layer 52A can function as the first outer electrode 50A. These are common to the configuration of the second plating layer 52B and are also common to the second embodiment.

In the above-described first embodiment, the shape of the core 20 is not limited to that described as an example in the above-described first embodiment. For example, the shape of the core 20 may be a substantially polygonal columnar shape other than a substantially quadrangular shape or may be a shape having a chamfered corner, a shape having a rounded corner, or a shape each side of which has a curved portion. Alternatively, the shape of the core 20 may be a substantially cubic shape having the same dimension in the lengthwise direction Ld and the widthwise direction Wd. This is common to the above-described second embodiment. For example, the winding core portion 130 may have a substantially columnar shape or a substantially polygonal columnar shape other than a substantially quadrangular shape. Alternatively, when viewed in the lengthwise direction Ld, the winding core portion 130 may have a substantially rectangular shape, a shape having a chamfered corner, a shape having a rounded corner, or a shape each side of which has a curved portion. The first flange portion 141 and the second flange portion 142 may each have a substantially spherical shape. The core 120 may include only one of the first flange portion 141 and the second flange portion 142. For example, the center of gravity of the first flange portion 141 and the center of gravity of the winding core portion 130 do not need to coincide with each other when viewed in the lengthwise direction Ld, and the first flange portion 141 may protrude from one of the four outer peripheral surfaces of the winding core portion 130, which are parallel to one another in the lengthwise direction Ld. Note that each of the overlapping regions RF may be located on a curved surface.

In each of the above-described embodiments, the electronic component to which the above-described technique is applied is not limited to the NTC thermistor component 10 and a wire-wound inductor component and may be a thermistor component other than a negative temperature coefficient thermistor component or an inductor component other than a wire-wound inductor component. For example, in the first embodiment, the electronic component to which the above-described technique is applied may be a multilayer capacitor component. The technique of each of the above-described embodiments can be applied to any electronic component that includes at least a component body and the first outer electrode 50A or the second outer electrode 50B that is laminated on a surface of the component body.

In each of the above-described embodiments, the material of the core 20 and the core 120 is not limited to that mentioned in the above-described embodiments. For example, the material of the core 20 and the core 120 may be manganese-zinc ferrite or copper-zinc ferrite.

In each of the above-described embodiments, the application method in the first coating application step and the application method in the second coating application step are not limited to those described as examples in the above-described embodiments. For example, the insulator may be laminated on the surfaces of the core 20 or the surfaces of the core 120 by printing, spin coating, or the like. This is common to the application method in the conductor application step.

In each of the above-described embodiments, the number of times application is performed in the conductor application step is not limited to that mentioned as an example in each of the above-described embodiments. For example, in the first embodiment, the number of times application is performed or the application positions may be changed in accordance with the areas that are covered with the first base electrode 51A and the second base electrode 51B. This is common to the first coating application step and the second coating application step.

In each of the above-described embodiments, the curing step is not limited to a heating step. For example, in the case where the sol P1 and the conductor sol are materials that are cured by being irradiated with ultraviolet rays, ultraviolet irradiation may be performed as the curing step.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a component body;

a first coating layer that partially covers a surface of the component body; and a second coating layer that partially covers the surface of the component body, wherein the electronic component has an overlapping region in which the first coating layer and the second coating layer overlap each other, the first coating layer and the second coating layer are both in direct contact with the component body, the first coating layer and the second coating layer are insulating layers, a portion of the surface of the component body is a continuous flat surface forming a plane, and the first coating layer, the second coating layer, and the overlapping region are on the plane in the continuous flat surface.

2. The electronic component according to claim 1, wherein a total thickness that is obtained by adding a thickness of the second coating layer to a thickness of the first coating layer in the overlapping region is about 1.4 times or more an average thickness of the first coating layer, which is located on the same plane, excluding the overlapping region.

3. The electronic component according to claim 2, wherein a total thickness that is obtained by adding a thickness of the second coating layer to a thickness of the first coating layer in the overlapping region is about 2.7 times or less an average thickness of the first coating layer, which is located on the same plane, excluding the overlapping region.

4. The electronic component according to claim 2, further comprising:

an outer electrode that is on the surface of the component body, wherein the outer electrode includes a base electrode, which is laminated on the surface of the component body, and a plating layer, which is laminated on a surface of the base electrode, and an entire surface of the component body is covered with the first coating layer, the second coating layer, and the base electrode.

5. The electronic component according to claim 2, further comprising:

an inner electrode that is embedded in the component body; and an outer electrode that is connected to the inner electrode, wherein the inner electrode includes an exposed portion that is exposed through the surface of the component body, the first coating layer, and the second coating layer, and the outer electrode covers a surface of the exposed portion.

6. The electronic component according to claim 2, wherein the first coating layer has a first protruding portion in which an edge of the first coating layer protrudes outward, the second coating layer has a second protruding portion in which an edge of the second coating layer protrudes outward, and an edge of the first protruding portion and an edge of the second protruding portion are edges of the overlapping portion.

7. The electronic component according to claim 2, wherein the overlapping region has a substantially continuous annular shape extending along the surface of the component body.

8. The electronic component according to claim 1, wherein a total thickness that is obtained by adding a thickness of the second coating layer to a thickness of the first coating layer in the overlapping region is about 2.7 times or less an average thickness of the first coating layer, which is located on the same plane, excluding the overlapping region.

9. The electronic component according to claim 8, further comprising:

an outer electrode that is on the surface of the component body, wherein the outer electrode includes a base electrode, which is laminated on the surface of the component body, and a plating layer, which is laminated on a surface of the base electrode, and an entire surface of the component body is covered with the first coating layer, the second coating layer, and the base electrode.

10. The electronic component according to claim 8, further comprising:

an inner electrode that is embedded in the component body; and an outer electrode that is connected to the inner electrode, wherein the inner electrode includes an exposed portion that is exposed through the surface of the component body, the first coating layer, and the second coating layer, and the outer electrode covers a surface of the exposed portion.

11. The electronic component according to claim 8, wherein the first coating layer has a first protruding portion in which an edge of the first coating layer protrudes outward, the second coating layer has a second protruding portion in which an edge of the second coating layer protrudes outward, and an edge of the first protruding portion and an edge of the second protruding portion are edges of the overlapping portion.

12. The electronic component according to claim 8, wherein the overlapping region has a substantially continuous annular shape extending along the surface of the component body.

13. The electronic component according to claim 1, further comprising:

an outer electrode that is on the surface of the component body, wherein the outer electrode includes a base electrode, which is laminated on the surface of the component body, and a plating layer, which is laminated on a surface of the base electrode, and an entire surface of the component body is covered with the first coating layer, the second coating layer, and the base electrode.

14. The electronic component according to claim 13, further comprising:

an inner electrode that is embedded in the component body; and an outer electrode that is connected to the inner electrode, wherein the inner electrode includes an exposed portion that is exposed through the surface of the component body, the first coating layer, and the second coating layer, and the outer electrode covers a surface of the exposed portion.

15. The electronic component according to claim 1, further comprising:

an inner electrode that is embedded in the component body; and an outer electrode that is connected to the inner electrode, wherein the inner electrode includes an exposed portion that is exposed through the surface of the component body, the first coating layer, and the second coating layer, and the outer electrode covers a surface of the exposed portion.

16. The electronic component of claim 1, wherein the first coating layer has a first protruding portion in which an edge of the first coating layer protrudes outward, the second coating layer has a second protruding portion in which an edge of the second coating layer protrudes outward, and an edge of the first protruding portion and an edge of the second protruding portion are edges of the overlapping portion.

17. The electronic component according to claim 16, further comprising:

an inner electrode that is embedded in the component body, wherein the component body has an end surface at which an end portion of the inner electrode is exposed from the component body, and the end portion is located in a region that is between the edge of the first coating layer and the edge of the second coating layer on the end surface and that is not covered with the first coating layer or the second coating layer.

18. The electronic component according to claim 1, wherein the overlapping region has a substantially continuous annular shape extending along the surface of the component body.

19. A method of manufacturing an electronic component including a component body, a first coating layer that partially covers a surface of the component body, and a second coating layer that partially covers the surface of the component body, the method comprising:

applying a first coating to a portion of the surface of the component body and drying the first coating;

applying a second coating to a portion of the surface of the component body and drying the second coating, such that the second coating is applied to overlap a portion of the first coating; and curing the first coating so as to form the first coating layer and curing the second coating so as to form the second coating layer, wherein the first coating layer and the second coating layer are both in direct contact with the component body, the first coating layer and the second coating layer are insulating layers, a portion of the surface of the component body is a continuous flat surface forming a plane, and the first coating layer, the second coating layer, and the overlapping region are on the plane in the continuous flat surface.

20. The method of manufacturing an electronic component according to claim 19, wherein the electronic component further includes an inner electrode that is embedded in the component body, the inner electrode has a portion exposed at the surface of the component body, during the first coating, the first coating is applied such that the portion is at least partially exposed through the first coating, and during the second coating, the second coating is applied such that the portion exposed through the first coating is at least partially exposed through the second coating, and an exposed portion is formed.

21. An electronic component comprising:

a component body;

a first coating layer that partially covers a surface of the component body; and a second coating layer that partially covers the surface of the component body, wherein the electronic component has an overlapping region in which the first coating layer and the second coating layer overlap each other, the first coating layer and the second coating layer are both in direct contact with the component body, the first coating layer and the second coating layer are insulating layers, and the electronic component has an exposed region in which the first coating layer is not overlapped by the second coating layer.

* * * * *